US008956040B2

(12) United States Patent
Cornaglia et al.

(10) Patent No.: US 8,956,040 B2
(45) Date of Patent: Feb. 17, 2015

(54) STATIC MIXER FOR THE TREATMENT OF EXHAUST GASES AND MANUFACTURING METHOD THEREOF

(75) Inventors: Pier Mario Cornaglia, Moncalieri (IT); Giorgio Villata, Chieri (IT)

(73) Assignee: Officine Metallurgiche G. Cornaglia S.p.A., Beinasco (TO) (IT)

( * ) Notice: Subject to any disclaimer, the term of this patent is extended or adjusted under 35 U.S.C. 154(b) by 0 days.

(21) Appl. No.: 14/126,975

(22) PCT Filed: Jun. 20, 2012

(86) PCT No.: PCT/IB2012/053102

§ 371 (c)(1),
(2), (4) Date: Dec. 17, 2013

(87) PCT Pub. No.: WO2012/176127

PCT Pub. Date: Dec. 27, 2012

(65) Prior Publication Data

US 2014/0133268 A1 May 15, 2014

(30) Foreign Application Priority Data

Jun. 20, 2011 (IT) ..... TO2011A0535

(51) Int. Cl.

| | |
|---|---|
| ***B61F 5/06*** | (2006.01) |
| ***F01N 3/28*** | (2006.01) |
| ***B01F 5/06*** | (2006.01) |

(52) U.S. Cl.

CPC ..... *F01N 3/2892* (2013.01); *B01F 5/0616* (2013.01); *F01N 2240/20* (2013.01); *B01F 2005/0639* (2013.01)

USPC ..... 366/337; 60/282

(58) Field of Classification Search

CPC ..... B01F 5/0616

USPC ..... 366/337; 48/189.4; 60/282

See application file for complete search history.

(56) References Cited

U.S. PATENT DOCUMENTS

| | | | | |
|---|---|---|---|---|
| 692,444 | A * | 2/1902 | Harris | 261/67 |
| 1,113,041 | A * | 10/1914 | Murphy | 48/189.4 |
| 1,118,237 | A * | 11/1914 | Saint Cyr | 48/189.4 |
| 1,285,192 | A * | 11/1918 | Hunt | 137/483 |
| 1,456,135 | A * | 5/1923 | Lidholm et al. | 48/189.4 |
| 1,921,282 | A * | 8/1933 | Cook | 48/189.4 |
| 4,600,544 | A * | 7/1986 | Mix | 261/79.2 |
| 7,128,049 | B2 * | 10/2006 | Doucet | 123/306 |
| 7,533,520 | B2 | 5/2009 | Cheng et al. | |
| 8,302,391 | B2 * | 11/2012 | Wirth et al. | 60/324 |
| 2007/0204751 | A1 | 9/2007 | Wirth et al. | |
| 2007/0245718 | A1 | 10/2007 | Cheng et al. | |
| 2008/0267780 | A1 * | 10/2008 | Wirth | 416/204 A |

(Continued)

OTHER PUBLICATIONS

International Search Report and Written Opinion for PCT/IB2012/053102 mailed Oct. 10, 2012.

*Primary Examiner* — David Sorkin

(74) *Attorney, Agent, or Firm* — RatnerPrestia

(57) ABSTRACT

Static mixer for the treatment of exhaust gases, including an annular support portion and a plurality of substantially coplanar radial vanes that are arranged radially with their rear portions or bases associated with the support portion and the front portions or radial tips converging towards the center of the mixer, wherein the body of the vanes includes at least three lines of bending, which define respective portions arranged on non parallel planes and defining corresponding impact surfaces for the exhaust gases.

5 Claims, 8 Drawing Sheets

(56) References Cited

U.S. PATENT DOCUMENTS

2009/0266064 A1 10/2009 Zheng et al.
2009/0320453 A1 12/2009 Salanta et al.
2011/0061369 A1 3/2011 Yetkin et al.

* cited by examiner

STATIC MIXER FOR THE TREATMENT OF EXHAUST GASES AND MANUFACTURING METHOD THEREOF

CROSS REFERENCE TO RELATED APPLICATIONS

This application is the U.S. National Phase Application of PCT/IB2012/053102, filed Jun. 20, 2012, which claims priority to Italian Patent Application No. TO2011A000535, filed Jun. 20, 2011, the contents of such applications being incorporated by reference herein.

TECHNICAL FIELD

The present invention relates to a static mixer for the treatment of exhaust gases and to the manufacturing method thereof.

More precisely, the invention relates to a static mixer for the treatment of exhaust gases of internal combustion engines, which mixer can be incorporated in a system for the selective catalytic reduction (SCR) of nitrogen oxides.

PRIOR ART

Static mixers are commonly used in order to promote mixing of the exhaust gases with the reducing agent, introduced in gaseous or liquid state into the exhaust systems of the internal combustion engines.

In this context, the static mixer is mainly aimed at promoting the formation of a highly homogeneous mixture and causing the reducing agent introduced into the exhaust system to be as much as possible vaporised.

In order to meet this requirement, static mixers are at present produced, which comprise a set of vanes with various orientations inside the duct where the exhaust gases and the reducing agent mixture flow.

The vanes are generally associated with an annular frame intended to adhere to the internal walls of the duct housing the mixer, which generally is transversally arranged in the duct so that the exhaust gas flow is intercepted by said vanes.

The static mixer promotes mixing of the gases with the reducing agent, generally thanks to the increase of the turbulence phenomenon within the exhaust gas flow.

Yet, the provision of a static mixer in the region where gases flow causes a pressure increase inside the exhaust system. Such a pressure increase is a drawback, since it is of hindrance to the discharge of the exhaust gases and, generally, it may be more or less significant depending on the arrangement of the mixer and the exhaust system.

Moreover, the surface of a mixer can cause condensation of the reducing mixture, with the consequent formation of a liquid film that adheres to the vanes, thereby causing a reduction in the effectiveness of the same mixer.

Thus, two phenomena are to be contrasted when designing a mixer of the above-mentioned kind.

The first phenomenon is the one determined by excessive pressure increases in the exhaust system housing the mixer. The second phenomenon is the one determined by the reduction of the mixing capability, resulting from the formation of condensate of the reducing agent onto the mixer surfaces.

In an attempt to achieve the best compromise between the opposite requirements of attaining a good mixing and preventing the occurrence of the above drawbacks, different solutions have been proposed hitherto.

Some solutions use a matrix of vanes of which the density, the inclination and the size are chosen by taking into account the above requirements. US 2007/0204751 discloses an example of such kind of mixer.

Other solutions use a set of vanes, which generally are radially arranged within the duct where the gases flow and are oriented so as to cause mixing of said gases with the reducing agent mixture. Static mixers of this second type are disclosed for instance in U.S. Pat. No. 7,533,520, US 2009/0320453 and US 2009/0266064.

In all aforesaid solutions, the effort to find the best compromise between the requirements of mixing and free flow for the exhaust gases is clearly apparent.

Notwithstanding those efforts, the prior art mixers however do not wholly solve the problem of how to obtain the best mixing, while at the same time minimising the above drawbacks.

Moreover, the efforts made till now result in solutions that are more and more elaborate, complex and expensive to be manufactured.

In the field, there is therefore still a strong need to have at disposal a static mixer which is highly efficient, does not cause significant pressure increases, is scarcely prone to promote the formation of condensate and does not have the above drawbacks related to the manufacturing complexity and costs.

Thus, it is a first object of the invention to achieve such a result, by providing a static mixer device for the treatment of exhaust gases, which enables a better mixing with respect to the prior art devices and causes a reduced pressure increase and a reduced capability to form condensate.

It is another object of the invention to provide a static mixer of the kind discussed above, which can be industrially manufactured in simpler manner and at lower costs than the prior art mixers.

It is a further, but not the last object of the invention to provide a mixer of the kind discussed above, which can be employed substantially in any exhaust system in which the selective catalytic reduction (SCR) technology is exploited.

The above and other objects are achieved by means of the static mixer for the treatment of exhaust gases and of the manufacturing method thereof as claimed in the appended claims.

DESCRIPTION OF THE INVENTION

A first advantage of the invention results from the provision of a plurality of radial vanes, arranged inside an annular perimeter, converging towards the centre of the mixer and comprising at least three lines of bending, which define an equal number of vane portions arranged on non parallel planes and defining corresponding impact surfaces for the exhaust gases.

Thanks to said arrangement, the mixer is capable of causing the formation of a turbulent flow with a swirl in the flow of gas and urea flowing through it and consequently of causing an effective mixing of urea with the exhaust gases.

The plurality of bending lines and the corresponding impact surfaces thus formed on the mixer vanes advantageously assist in increasing the overall surface against which the urea spray impinges, thus determining a high nebulisation. Moreover such an arrangement contributes to reducing the phenomenon of creation of a liquid film downstream the mixer, which film, as known, reduces the mixer performance.

Another advantage of the invention results from the provision, in the mixer, of a free central portion, that is, a portion having no obstacles for the free flow of the exhaust gases, towards which the radial vanes converge. Thanks to such a free central portion and to the shape of the radial vanes, it is possible to obtain an effective mixing effect of the exhaust gases with the reducing agent mixture. Such a mixing effect is promoted by the presence of said central hole, which, on the other hand, contributes to preventing an excessive increase of the pressure due to the provision of the mixer. Indeed, in correspondence of the central hole, an increase in the gas speed and a consequent intense forward thrust of the gases occur, resulting in an advantageous turbulent motion downstream the mixer.

A further advantage of the invention results from the possibility of manufacturing the mixer by means of a succession of simple cutting and bending operations.

BRIEF DESCRIPTION OF THE FIGURES

Some preferred embodiments of the invention will be described hereinafter with reference to the accompanying Figures, in which.

DESCRIPTION OF A PREFERRED EMBODIMENT

Figure 1:
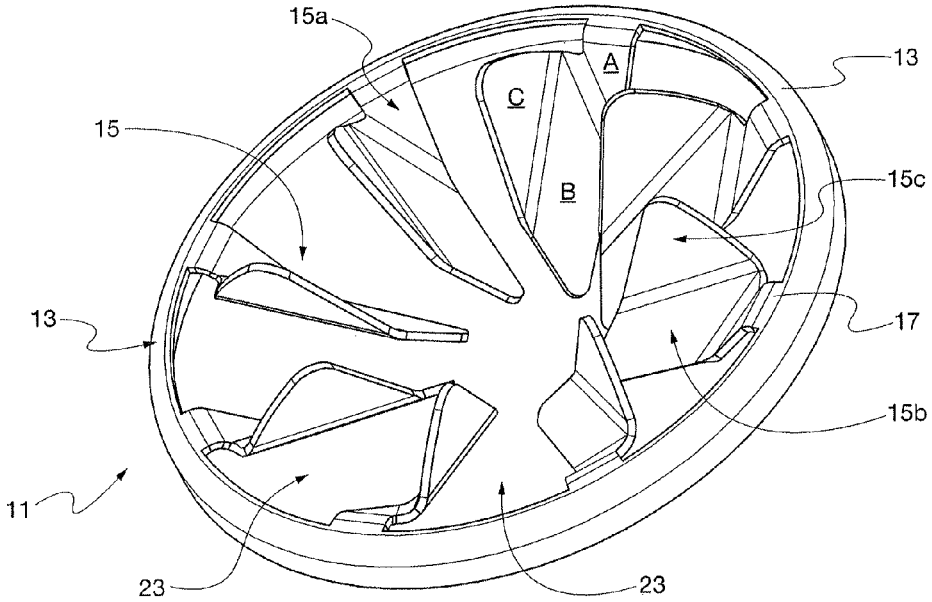
FIG. 1 is a front perspective view of the mixer according to the invention.

Referring to FIGS. 1 to 4, the static mixer for the treatment of exhaust gases according to the invention has been generally denoted by reference numeral 11.

Mixer 11 includes an annular support portion 13 and a plurality of substantially coplanar radial vanes 15, which are radially arranged and have their rear ends or bases 17 associated with said support portion 13 and their front ends or radial tips 19 converging towards centre "G" of the mixer.

According to the invention, the body of each vane 15 comprises at least three lines of bending I1, I2, I3, which define an equal number of portions 15*a*, 15*b*, 15*c* arranged on non parallel planes and defining corresponding impact surfaces A, B, C for the exhaust gases. Preferably moreover said impact surfaces A, B, C are substantially flat.

Still according to the invention, radial tips 19 of vanes 15 encircle a central portion 21 of the mixer. Said portion 21, which is substantially circular in the illustrated example, is free, that is, it is not occupied by the vanes or other parts of the mixer and it defines a passageway, free from interferences, for the exhaust gases.

Figure 2:
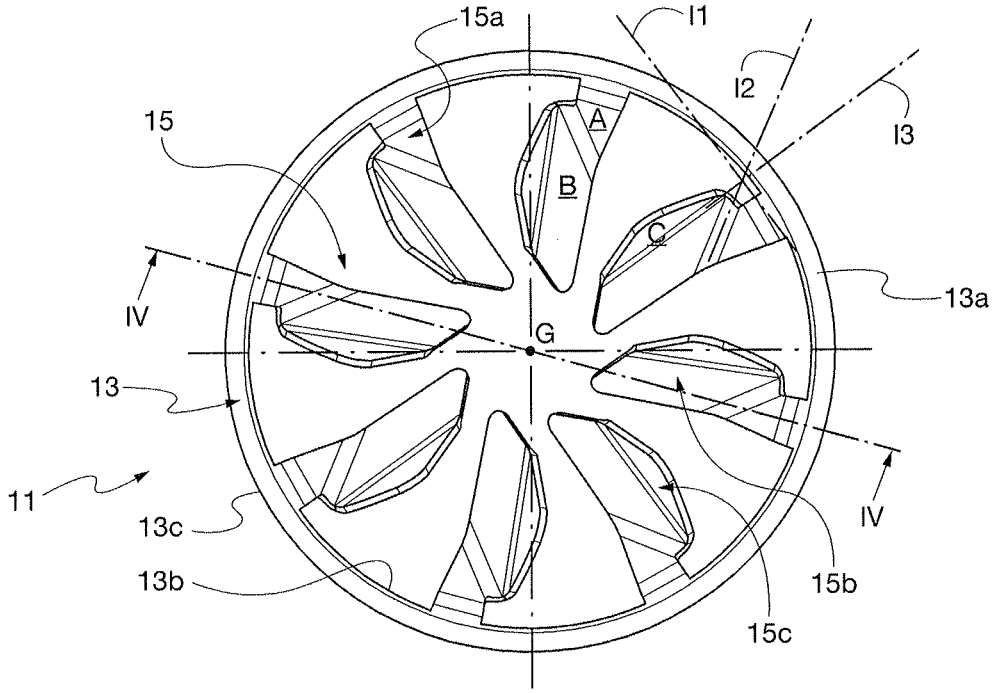
FIG. 2 is a plan view of the mixer shown in FIG. 1.
Figure 3:
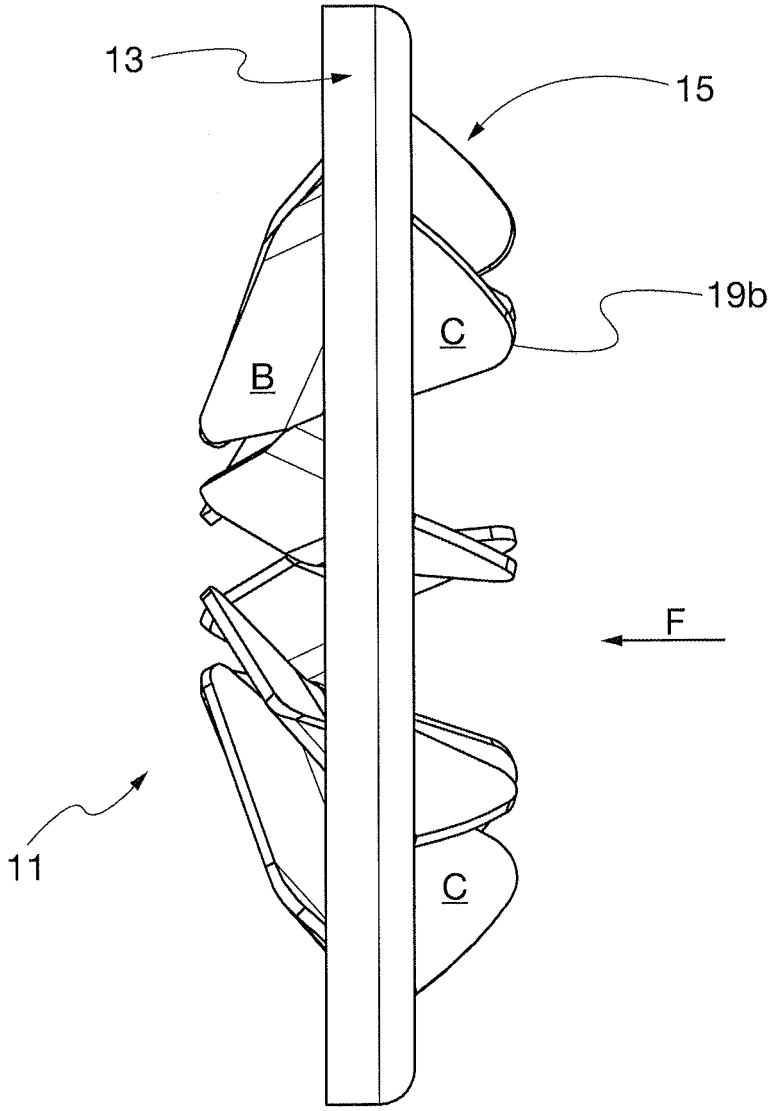
FIG. 3 is a side view of the mixer shown in FIG. 1.

Always according to the invention, impact surfaces A, B, C for the exhaust gases lie on non parallel planes with respect to a transversal plane "P" on which the mixer lies and which substantially corresponds to the plane of the sheet comprising FIG. 2. Said planes on which the impact surfaces lie are thus non perpendicular to the flow direction of the exhaust gases passing through the mixer, said direction being denoted by arrow "F" in FIG. 3. Moreover, the planes on which impact surfaces A, B, C lie are non parallel to each other and intercept the gas flow and the reducing mixture according to different angles. Preferably, said angles decrease from vane base 17 towards the periphery.

In a preferred embodiment of the invention, a first impact surface A adjacent to base 17 of vane 15 is inclined by an angle in the range 30° to 60° with respect to said transversal plane P of the mixer. In the illustrated embodiment, the first impact surface A has moreover substantially the shape of a rectangular trapezoid.

Always in accordance with a preferred embodiment of the invention, a second impact surface B adjacent to the first impact surface A is inclined by an angle in the range 40° to 70° with respect to the first impact surface A. In the illustrated embodiment, the second impact surface B is moreover substantially rectangular.

Still in accordance with a preferred embodiment of the invention, a third impact surface C adjacent to the second impact surface B is inclined by an angle in the range 20° to 50° with respect to the second impact surface. In the illustrated embodiment, the third impact surface C is substantially triangular and defines moreover an axial tip 19*b* longitudinally directed towards the front region of mixer 11, from which exhaust gases arrive.

Preferably, according to the invention, impact surfaces A, B, C define in the whole a concave portion for each vane, with the concavity turned in opposite direction with respect to gas flow direction "F".

Annular support portion 13 includes a crown 13*a*, preferably closed to form a ring, which in the illustrated example defines a circular internal perimeter 13*b* and a circular external perimeter 13*c* for mixer 11. Other embodiments will be however possible, in which internal perimeter 13*b* and/or external perimeter 13*c* have a shape different from the circular one, for instance an octagonal, hexagonal, square or rectangular shape. In still other embodiments, vanes 15 could be directly associated with the inner wall of the duct of the exhaust system housing the mixer. In such case, annular support 13 will be an integral portion of the duct.

According to a preferred embodiment of the invention, vanes 15 are angularly spaced apart in regular manner along internal perimeter 13*b* of annular support portion 13.

Always referring to a preferred embodiment of the invention, eight radial vanes 15 are provided. The optimal number of vanes 15 can however be chosen depending on the characteristics of the exhaust system into which the mixer is incorporated, and generally any number of vanes can be provided. Thus, other embodiments of the mixer will be possible, in which the number of vanes is different from eight. A number of vanes ranging from four to sixteen has proved to provide the best performance.

Moreover, in a preferred embodiment, the diameter of circular central portion 21 is about ¼ the diameter of internal perimeter 13*b* of the mixer.

In the whole, inside internal perimeter 13*b*, mixer 11 has a region occupied by the plurality of vanes 15 intercepting the exhaust gases and the reducing agent mixture, and a free region formed by the zones included between the vanes and denoted by reference numeral 23, as well as by central portion 21.

Figure 5:
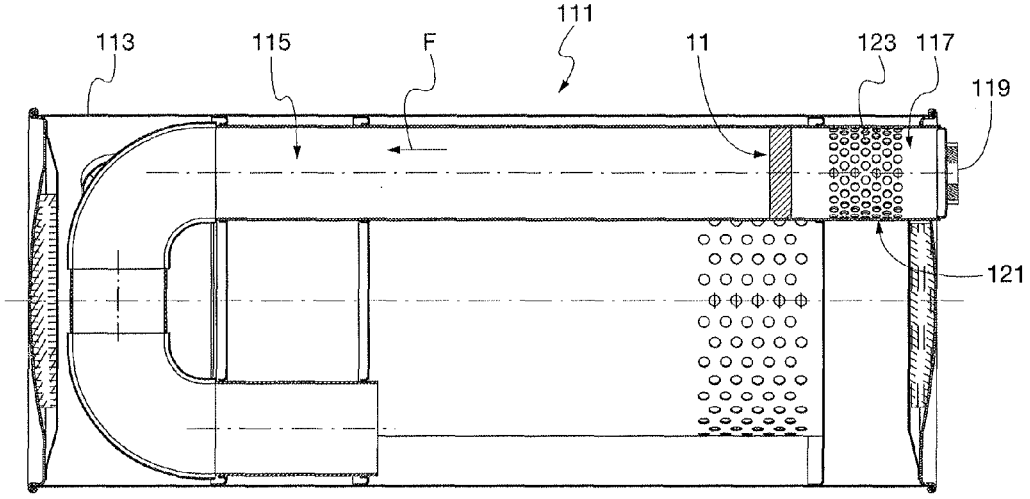
FIG. 5 is a schematic view of an exhaust system incorporating the mixer.

Referring to FIG. 5, there is schematically shown a unit 111 for the treatment of the exhaust gases of an internal combustion engine, where SCR technology is used. Said unit 111 comprises a set of ducts for the exhaust gases, housed within a casing 113. Static mixer 11 according to the invention is housed in one of the ducts, denoted in the Figure by reference numeral 115, in which the exhaust gases flow in the direction indicated by arrow "F". In the illustrated example, mixer 11 is transversally arranged within duct 115, immediately downstream region 117 where the reducing agent mixture is introduced. Always with reference to the illustrated example, the reducing agent mixture is introduced by injection by means 119 preferably including a nozzle or a suitable valve and axially arranged at the beginning of duct 115, in the direction of the exhaust gas flow. Said duct 115 further comprises, between means 119 and mixer 11, a radially oriented exhaust gas inlet 121, formed by a corresponding portion of duct 115 provided with radial holes 123.

In accordance with the above configuration, which corresponds to the preferred but non exclusive arrangement, exhaust gases radially enter duct 115 and they are intercepted by the reducing agent arriving in axial direction, that is at 90° with respect to the gas inlet direction. Hence, the exhaust gas flow arrives in axial direction, i.e. deflected by about 90° with respect to the inlet direction into duct 115, at mixer 11, which substantially occupies the whole cross section of duct 115.

Advantageously, according to the invention, mixer 11 can be manufactured by means of a succession of simple working operations.

According to a preferred method of manufacture, the mixer is obtained from a sheet metal body having a thickness preferably ranging from 0.8 to 2.0 mm, and more preferably of 1.5 mm. Vanes 15 will have therefore substantially a laminar consistence.

Preferably, as it will be explained hereinafter, the mixer is manufactured by means of mechanical cutting and bending operations. In the alternative, the mixer could also be manufactured by other mechanical workings, for instance milling or electron discharge machining.

In a preferred embodiment of the method of manufacturing the mixer, which will be disclosed hereinafter, the machining of a flat laminar metal body, for instance a foil of sheet metal, is performed.

Figure 6:
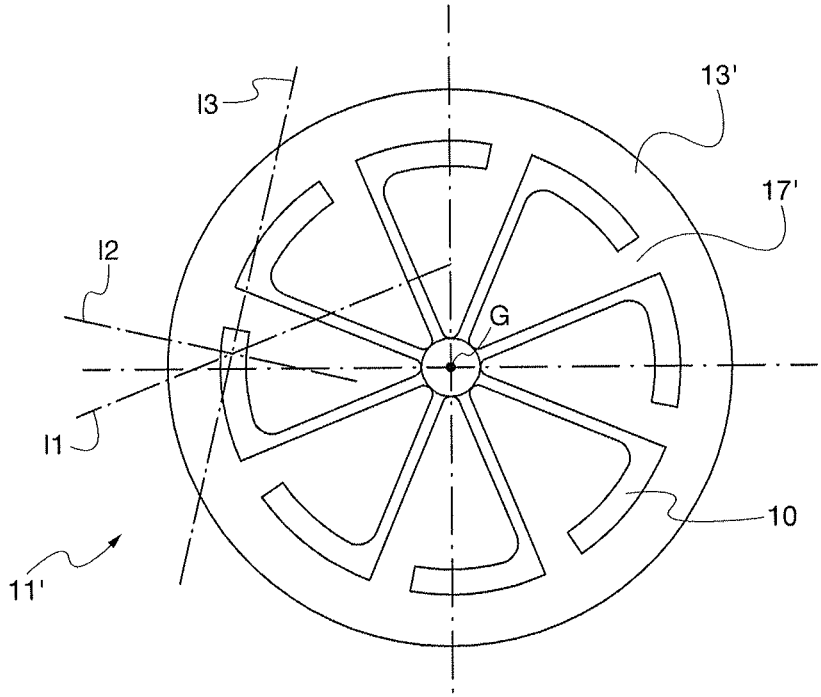
FIG. 6 is a plan view of the mixer, in a first working step.

Referring to FIG. 6, the starting product is shown, which comprises a flat body 11' obtained for instance by cutting or shearing a flat foil of sheet metal.

In the illustrated example, body 11' is disc shaped with an outer diameter of about 140 mm and comprises eight vanes 15' angularly spaced apart in regular manner. In this step of the working of the mixer, and always referring to the illustrated example, vanes 15' have a substantially flat, triangular shape and one of their vertices is directed towards centre "G" of the disc-shaped body. More precisely, always referring to the illustrated example, vanes 15' are shaped as isosceles triangles with the base angles of about 70° and the vertex angle of about 45°.

Raw vanes 15' are subsequently bent along bending lines I1, I2, I3, for instance by means of a robotised manipulator, thereby obtaining the final product corresponding to mixer 11 disclosed with reference to FIGS. 1 to 4.

In a preferred embodiment of the invention, in order to make bending of vanes 15' easier and to reduce the extension of the impact surfaces of the vanes when the mixer is ended, and hence to limit the pressure increase within the duct that will house the mixer, body 11' undergoes removal of material in a more or less wide band around the vanes. Said band is denoted by reference numeral 10 in FIG. 6 and it extends around the vanes, with the exception of an appendage 17' connecting the vanes to support portion 13'.

Figure 7:
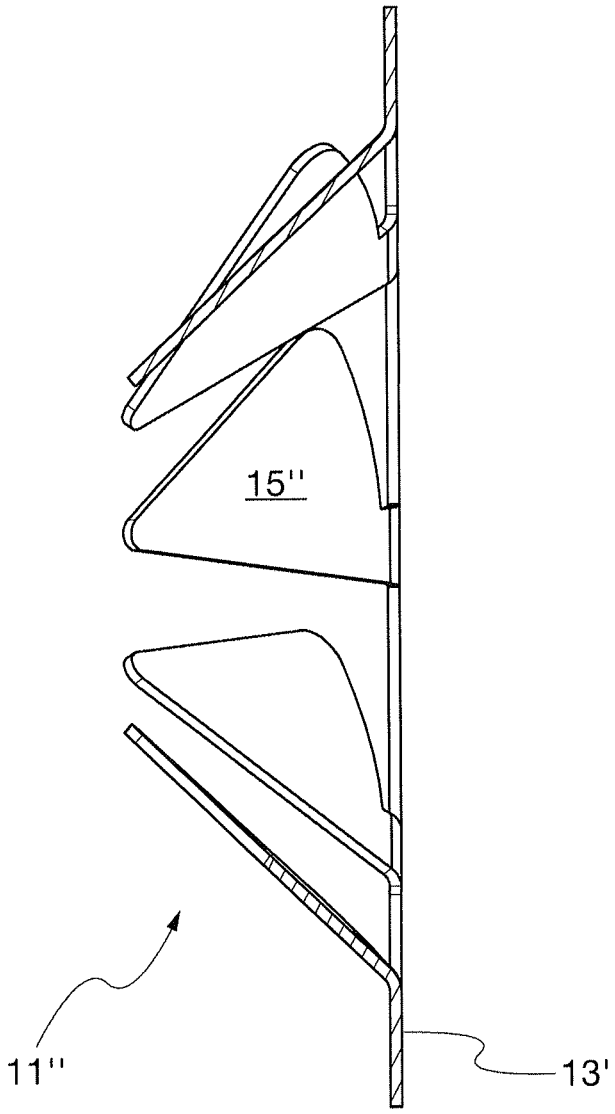
FIG. 7 is a cross-sectional view taken along a longitudinal plane of the mixer, in a second working step.
Figure 8:
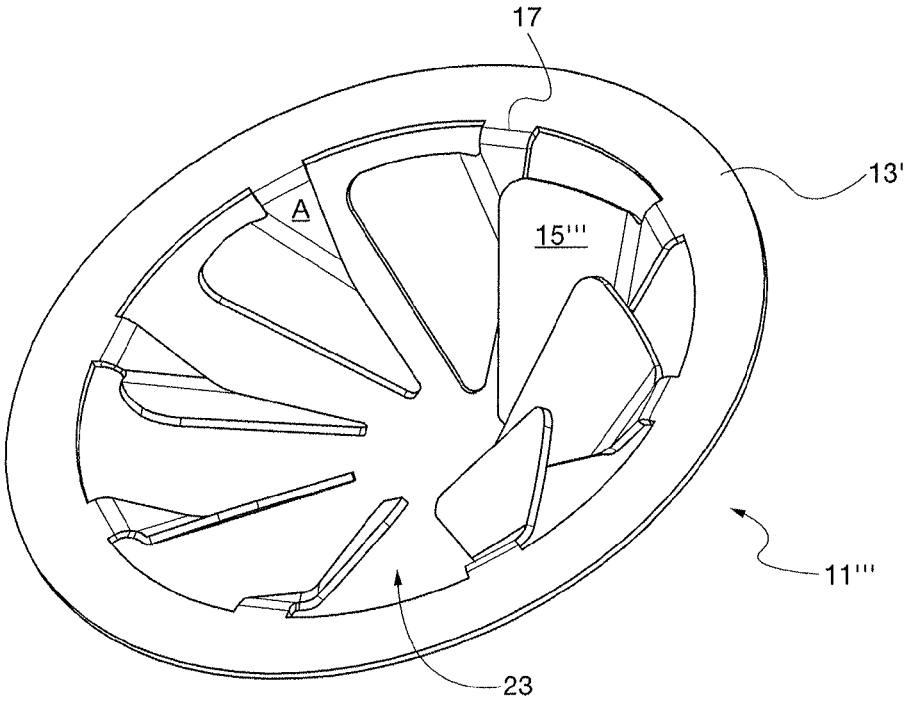
FIG. 8 is a front perspective view of the mixer, in a third working step.

FIG. 7 shows a subsequent step of the manufacture of the mixer, in which vanes 15" have been obtained by bending vanes 15' shown in FIG. 6 about the first bending line I1. A second bending along the second bending line I2 allows obtaining body 11'" shown in FIG. 8, and a third bending along the third bending line I3 allows obtaining mixer 11 in its final shape, shown in FIGS. 1 to 4.

Figure 4:
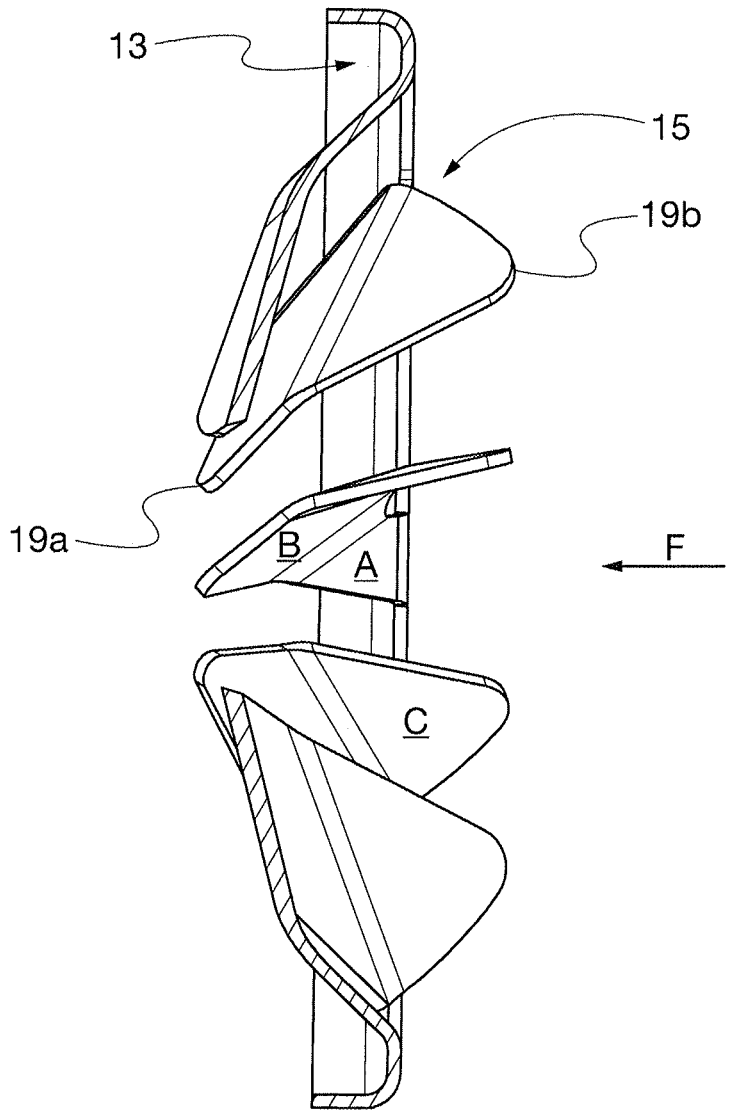
FIG. 4 is a cross-sectional view taken along line IV-IV in FIG. 2.

It is to be appreciated that also support portion 13 of the mixer can undergo a working, e.g. a drawing, starting from flat portion 13' in order to obtain the "L" shaped section shown in FIG. 4.

In the whole, the method according to the invention comprises the steps of:

- providing a substantially flat laminar metal body 11';
- forming on said body of sheet metal, for instance by cutting the sheet metal, a plurality of radial vanes 15' radially arranged and substantially coplanar;
- bending vanes 15' about a first bending line I1, thereby obtaining bent vanes 15";
- bending bent vanes 15" about a second bending line I2, thereby obtaining double-bent vanes 15'";
- bending double-bent vanes 15'" about a third bending line I3, thereby obtaining mixer 11.

Several changes and modifications, included within the same inventive principle, can be made to the static mixer as described and shown.

The invention claimed is:

1. An exhaust system for the treatment of exhaust gases of internal combustion engines comprising a duct housing a static mixer for the treatment of the exhaust gases, comprising an annular support portion and a plurality of substantially coplanar radial vanes that are arranged radially with their rear portion or base associated with said support portion and the front portion or radial tip converging towards the centre of the mixer, wherein the vanes comprise at least three lines of bending, which define respective portions arranged on non parallel planes and defining corresponding impact surfaces for the exhaust gases,

- wherein said impact surfaces for the exhaust gases lie on non-parallel planes with respect to a transversal plane of the mixer and are thus non-perpendicular to the flow direction of the exhaust gases passing through the mixer,
- wherein a first impact surface adjacent to the base of the vane is inclined of an angle comprised between 30° and 60° with respect to the middle transversal plane of the mixer,
- wherein a second impact surface adjacent to the first impact surface is inclined of an angle comprised between 40° and 70° with respect to the first impact surface, and
- wherein a third impact surface adjacent to the second impact surface is inclined of an angle comprised between 20° and 50° with respect to the second impact surface.

2. The exhaust system according to claim 1, wherein said impact surfaces define a concave portion for each vane.

3. The exhaust system according to claim 1, wherein the radial tips of the vanes encircle a free central portion of the mixer for the passage of the gases.

4. The exhaust system according to claim 1, wherein the vanes are angularly spaced apart in a regular way.

5. The exhaust system according to claim 1, wherein the vanes are from four to sixteen in number.

* * * * *